US009605838B2

(12) United States Patent
Kim et al.

(10) Patent No.: US 9,605,838 B2
(45) Date of Patent: Mar. 28, 2017

(54) SAFE LIGHTING SYSTEM USING WALL MOUNTED LIFT

(71) Applicants: NEW TECHNOLOGY BANK CO., LTD, Daejeon (KR); Kyung Hwan Kim, Daejeon (KR)

(72) Inventors: Kyung Hwan Kim, Daejeon (KR); Tae Su Lee, Daejeon (KR); Ji Seon Kim, Daejeon (KR)

(73) Assignees: Kyung Hwan Kim, Daejeon (KR); NEW TECHNOLOGY BANK CO., LTD., Daejeon (KR)

( * ) Notice: Subject to any disclaimer, the term of this patent is extended or adjusted under 35 U.S.C. 154(b) by 56 days.

(21) Appl. No.: 14/736,981

(22) Filed: Jun. 11, 2015

(65) Prior Publication Data

US 2016/0363301 A1 Dec. 15, 2016

(51) Int. Cl.

| | |
|---|---|
| ***F21V 21/36*** | (2006.01) |
| ***F21V 21/38*** | (2006.01) |
| ***F21V 21/16*** | (2006.01) |
| ***F21V 21/34*** | (2006.01) |
| *F21S 8/00* | (2006.01) |
| *F21V 15/01* | (2006.01) |
| *F21W 131/103* | (2006.01) |

(52) U.S. Cl.

CPC ..... *F21V 21/38* (2013.01); *F21V 21/16* (2013.01); *F21V 21/34* (2013.01); *F21S 8/036* (2013.01); *F21V 15/01* (2013.01); *F21W 2131/103* (2013.01)

(58) Field of Classification Search

CPC ..... F21V 21/34; F21V 21/38; F21V 21/22
USPC ..... 362/403
See application file for complete search history.

(56) References Cited

U.S. PATENT DOCUMENTS

| | | | | | |
|---|---|---|---|---|---|
| 317,215 | A * | 5/1885 | Schuette | F21V 21/38 | 246/484 |
| 3,949,842 | A * | 4/1976 | Kiehn | F16D 59/02 | 188/189 |
| 4,051,525 | A * | 9/1977 | Kelly | G08B 13/19632 | 348/143 |
| 5,975,726 | A * | 11/1999 | Latimer | F21V 21/38 | 362/249.07 |
| 6,161,943 | A * | 12/2000 | Chang | B65H 75/4407 | 362/218 |

(Continued)

FOREIGN PATENT DOCUMENTS

KR 10-0813696 B1 3/2008

*Primary Examiner* — Nimeshkumar Patel
*Assistant Examiner* — Christopher Raabe
(74) *Attorney, Agent, or Firm* — Rabin & Berdo, P.C.

(57) ABSTRACT

A safe lighting system using wall mounted lift comprises a polygonal pipe cylinder installing at a building wall; a polygonal lifting unit moving up and down along the inner wall of the polygonal pipe cylinder; a wire adjusting the height of the polygonal lifting unit, wherein the wire is connected to the upper side of the polygonal lifting unit; a lifting control unit controlling the height of the polygonal lifting unit by winding or releasing the wire; and a lighting apparatus installed at the polygonal lifting unit, wherein the height of the lighting apparatus is adjusted by the lifting control unit, and the installation and the maintenance of the lighting apparatus can be done conveniently on the ground by lowering the lighting apparatus.

9 Claims, 4 Drawing Sheets

(56) References Cited

U.S. PATENT DOCUMENTS

| | | | | |
|---|---|---|---|---|
| 6,447,150 | B1 * | 9/2002 | Jen | G08B 13/19619 248/125.2 |
| 6,665,968 | B2 * | 12/2003 | Jen | G08B 13/19619 248/125.2 |
| 7,004,043 | B2 * | 2/2006 | Erel | G08B 13/19619 248/125.2 |
| 2003/0024144 | A1 * | 2/2003 | Jen | G08B 13/19619 40/601 |

* cited by examiner

SAFE LIGHTING SYSTEM USING WALL MOUNTED LIFT

TECHNICAL FIELD

The present invention relates to a safe lighting system using wall mounted lift, and more specifically, to a lighting apparatus installed at a lifting unit which moves up and down along the wall of a building for easy height adjustment, convenient maintenance, and enhanced safety.

BACKGROUND ART

Lighting apparatus installed three-dimensionally at spaces located high position relatively is efficient and convenient in a space usage, since the ground of a building, a public construction building, or a factory building has more usage. An example of the three dimensional installation is to use a celling or a wall of a building structure.

However, as the lighting apparatus installed at a high position of a gymnasium, an auditorium, a concert hall, a convention center, a street light, and a factory building need to use a ladder for maintenance, the long working time of a maintenance engineer are needed. Moreover, the height of the lighting apparatus cannot be adjusted freely by users during the maintenance working, which might result in safety accidents.

Korea registered patent No.10-0813696 discloses a lighting apparatus which has a track installed at a celling and moves along the track. However, it has problems that have high installation cost and complicated control.

SUMMARY OF THE INVENTION

In order to solve the above problems, the present invention provides a safe lighting system using wall mounted lift, which can freely adjust not only the height of the lighting apparatus but also provide convenient maintenance. It also provides the enhanced safety.

According to the present invention in order to solve the above problems, the safe lighting system using wall mounted lift comprises: a polygonal pipe cylinder installing at a building wall; a polygonal lifting unit moving up and down along the inner wall of the polygonal pipe cylinder; a wire adjusting the height of the polygonal lifting unit, wherein the wire is connected to the upper side of the polygonal lifting unit; a lifting control unit controlling the height of the polygonal lifting unit by winding or releasing the wire; and a lighting apparatus installing at the polygonal lifting unit, wherein the height of the lighting apparatus is adjusted by the lifting control unit, and the installation and the maintenance of the lighting apparatus can be done conveniently on the ground by lowering the lighting apparatus.

The polygonal lifting unit and the polygonal pipe cylinder is the same hexagonal shape so that The polygonal lifting unit is inserted into the polygonal pipe cylinder.

One side of the polygonal pipe cylinder is fixed to a wall and an opening is formed in the opposite side of the polygonal pipe cylinder along the longitudinal direction.

Stopping bumps are symmetrically formed in the inner wall of the polygonal pipe cylinder.

One side of the polygonal lifting unit is protruded outside through the opening of the polygonal pipe cylinder, and an inserting hole is formed in a protrusion part for fixing the lighting apparatus to the bracket of the lighting apparatus.

The polygonal lifting unit has a clamped stopper in the down side for stopping it to the stopping bump which is formed periodically with a certain distance in the inner wall of the polygonal pipe cylinder.

The lifting control unit comprises: a wire control unit adjusting the wire length by winding or releasing the wire; a releasing unit releasing the clamped stopper which is installed in the down side of the polygonal lifting unit; and a turn roller installed to the upper side of the polygon pipe cylinder, which is changing the tensile direction by hooking the wire.

The stopper is an 'L' shaped latch which has minor symmetry. A torsion spring is connected to both sides below the stopper, and a releasing unit is connected to the center of the torsion spring.

BRIEF DESCRIPTION OF DRAWINGS

FIG. 5*a* shows the retracting state with ascending and FIG. 5*b* shows the spreading sate with stopping.

DETAILED DESCRIPTION OF THE INVENTION

Hereinafter, exemplary embodiments of the present invention will be described with drawings. In each drawing of the present invention, a size may be enlarged or reduced than an actual size to clarify the invention, and well known elements are omitted to emphasize a structural feature of the present invention.

The present invention relates to a safe lighting system which provides the easy height adjustment and the convenient maintenance of a lighting apparatus by installing it to a lifting unit which moves up and down along the inner wall of a polygonal pipe cylinder.

Figure 1:
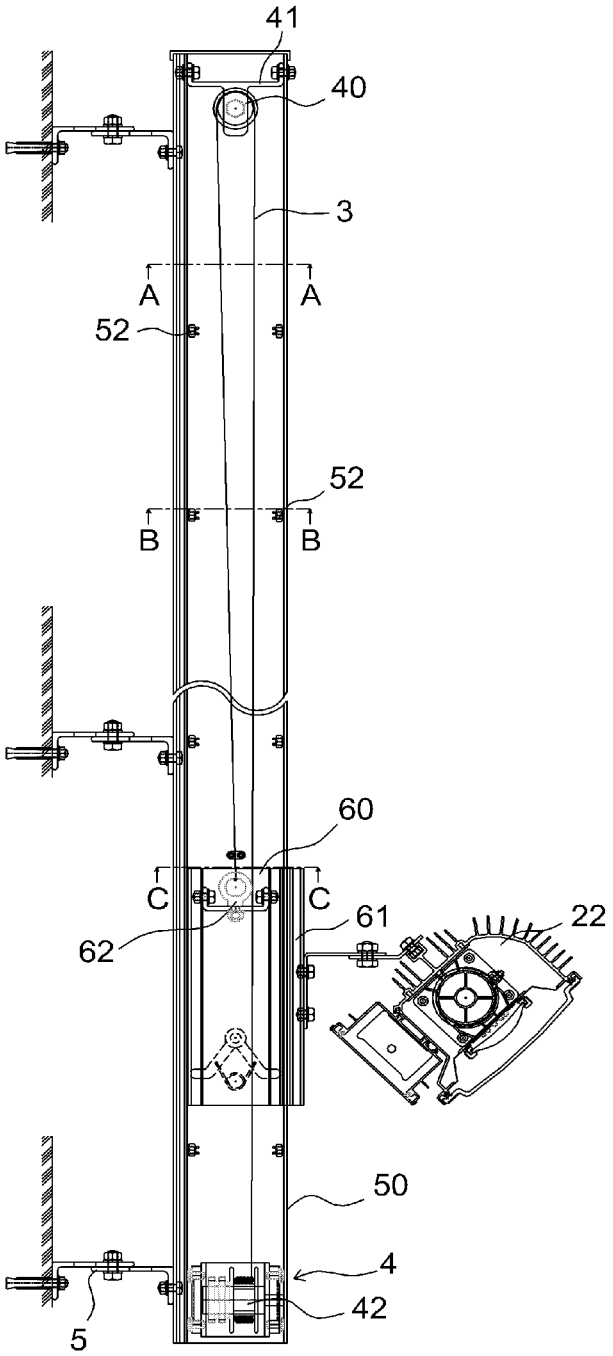
FIG. 1 illustrates a longitudinal sectional view of a safe lighting system which shows the lower state of the polygonal lifting unit according to the present invention.

FIG. 1 illustrates a longitudinal sectional view of a safe lighting system which shows the lower state of the polygonal lifting unit according to the present invention. The lighting system comprises: a polygonal pipe cylinder 50 installed using the fixing bracket 5 in the inside or the outside of a wall of a building structure; a polygonal lifting unit 60 moving up and down along the inner wall of the polygonal pipe cylinder 50; a wire 3 adjusting the height of the polygonal lifting unit, wherein the wire is connected to the upper side of the polygonal lifting unit 60; a lifting control unit 4 controlling the height of the polygonal lifting unit 60 by winding or releasing the wire; and a lighting apparatus 22 installed at the polygonal lifting unit.

The polygonal pipe cylinder is square, hexagonal, or octagonal shape. An outside plane of the polygonal pipe cylinder is fixed to a wall using the fixing bracket 5 and the outside fixing groove 54. An opening 51 is formed in the opposite side of the outside fixing groove of the polygonal pipe cylinder along the longitudinal direction.

Stopping bumps 52 which protruded from the inner wall are formed symmetrically with a certain periodic distance in other side plane of the inner wall of the polygonal pipe cylinder by inserting bolts or similar one. A guiding groove 53 is formed symmetrically to longitudinal direction in the inner wall of the polygonal pipe cylinder. It controls the insertion depth of the stopping bump 52 and guides both ends of the stopper 63. The polygonal pipe cylinder of the present invention can be made by an extrusion method using aluminum.

The polygonal lifting unit 60 is inserted in the inner wall of the polygonal pipe cylinder 50 which has square, hexagonal, or octagonal shape and moves up and down along the inner wall of the polygonal pipe cylinder 50. The polygonal lifting unit has a paired male and female polygonal structure with the polygonal pipe cylinder to fit each other. That makes to slide the polygonal lifting unit along the inner wall of the cylinder without a rail track and provides the safe lift of the polygonal lifting unit without a rotation change.

The polygonal lifting unit 60 has a protrusion in a side that is protruded outside from the opening 51 of the polygonal pipe cylinder 50. The protrusion can be made together with the polygonal lifting unit by an extrusion method. An inserting hole 61 is formed in the protrusion side for fixing the lighting apparatus 22 by combining it with the bracket of the lighting apparatus using a bolt.

The concave groove 65 is formed in two planes of the inner wall of the polygonal lifting unit 60 for passing of the guiding groove 53 of the polygonal pipe cylinder. The inner fixing groove 66 is formed in other two planes of the inner wall of the polygonal lifting unit to longitudinal direction with a protrusion in the inside for fixing the wire bracket 62. The polygonal lifting unit of the present invention can be made by extrusion method using aluminum.

The wire bracket 62 is installed at the top side of the polygonal lifting unit 60 for the connection of a wire 3. A stopper is installed at the down side of the polygonal lifting unit 60. The stopper prevents from descending of the polygonal lifting unit 60 by hooking it a stopping bump which is formed in the inner wall of the polygonal pipe cylinder or allows the descending using a releasing unit 43.

Figure 2:
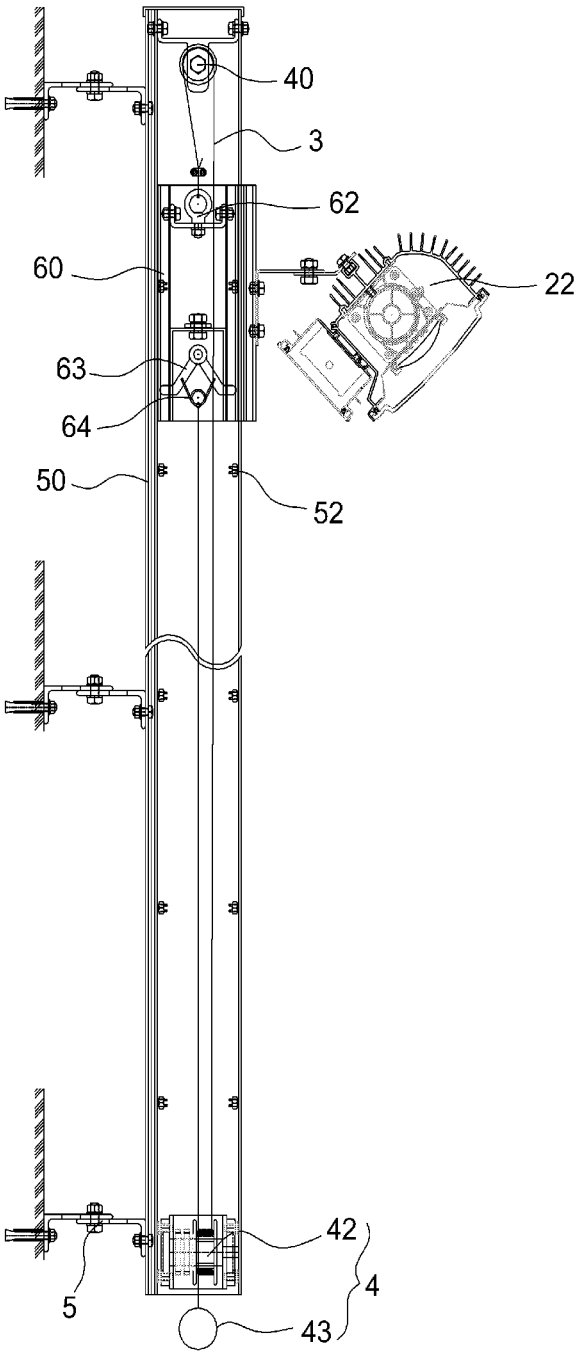
FIG. 2 illustrates a longitudinal sectional view of a safe lighting system which shows the upper state of the polygonal lifting unit according to the present invention.

FIG. 2 illustrates a longitudinal sectional view of the ascending state of the polygonal lifting unit.

Figure 3:
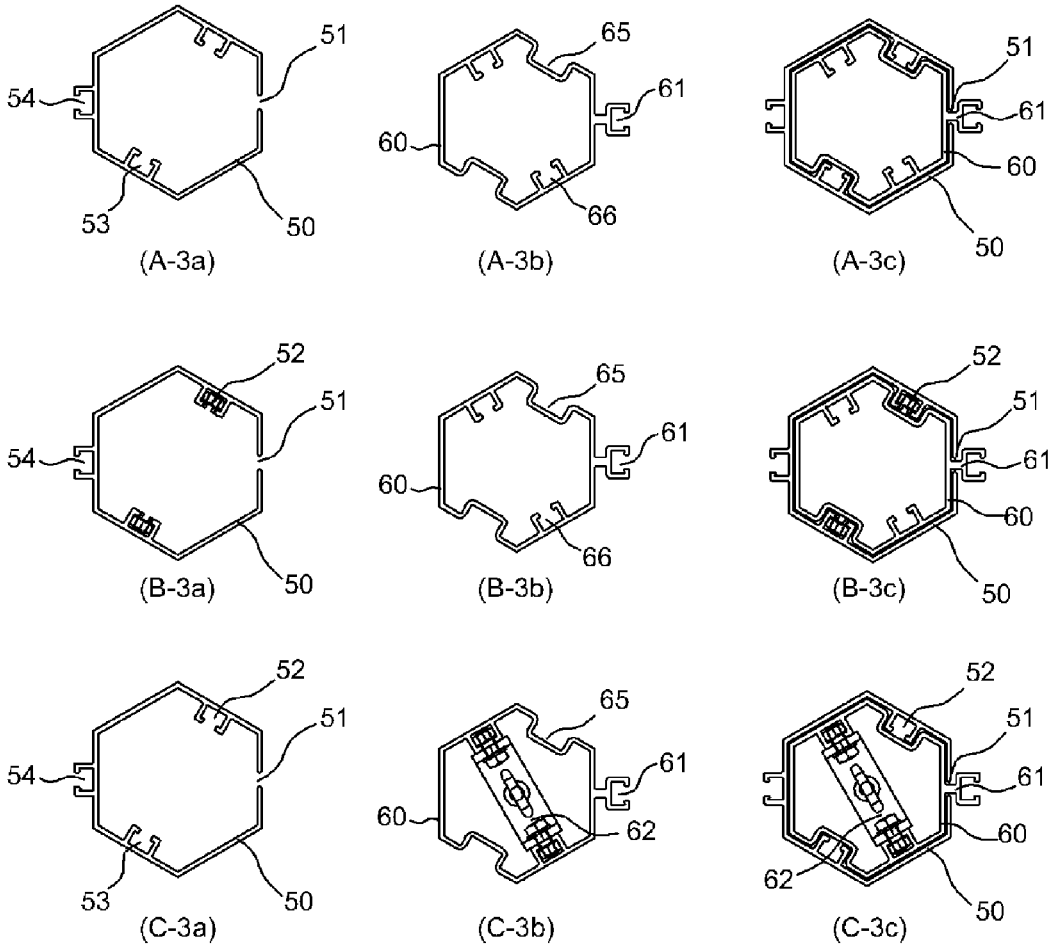
FIG. 3 illustrates a cross sectional view of each part indicated in FIG. 1: A-3*a* shows a A-A cross sectional view of a polygonal pipe cylinder; A-3*b* shows a cross sectional view of a lifting unit; and A-3*c* shows a cross sectional view of the inserted lifting unit. B-3*a* shows a B-B cross sectional view of the polygonal pipe cylinder; B-3*b* shows a cross sectional view of the polygonal lifting unit; and B-3*c* shows a cross sectional view of the inserted lifting unit. C-3*a* shows a C-C cross sectional view of the polygonal pipe cylinder; C-3*b* shows a C-C cross sectional view of the polygonal lifting unit; and C-3*c* shows a C-C cross sectional view of the inserted lifting unit.

FIG. 3 illustrates a cross sectional view of A-A, B-B, and C-C as described in FIG. 1.

The A-A part has no a stopping bump 52; A-3*a* shows a A-A cross sectional view of a polygonal pipe cylinder, A-3*b* shows a cross sectional view of a lifting unit, and A-3*c* shows a cross sectional view of the inserted polygonal lifting unit.

The B-B part has stopping bumps 52 which are formed the inner wall of the polygonal pipe cylinder, B-3*a* shows a B-B cross sectional view of the polygonal pipe cylinder, B-3*b* shows a cross sectional view of the polygonal lifting unit, and B-3*c* shows a cross sectional view of the inserted polygonal lifting unit.

The C-C part has a lifting unit 60 without a stopping bump 52; C-3*a* shows a C-C cross sectional view of the polygonal pipe cylinder, C-3*b* shows a C-C cross sectional view of the polygonal lifting unit, and C-3*c* shows a C-C cross sectional view of the inserted polygonal lifting unit The polygonal lifting unit 60 moves up or down together with a lighting apparatus 22 combined with the insert hole 61 through the opening 51 of the polygonal pipe cylinder.

Figure 4:
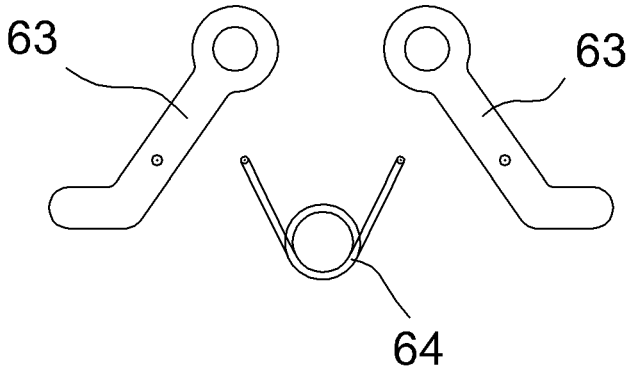
FIG. 4 illustrates the exploded view of the stopper unit.

FIG. 4 illustrates an exploded view of the stopper unit of the polygonal lifting unit according to the present invention. The stopper 63 is an 'L' shaped latch which has minor symmetry. A through hole is formed in the upper side of the 'L' shaped latch. It allows rotation by binding it with bolts under retracting state each other and fixing one direction. A torsion spring 64 is connected to both sides of the down side of the stopper, and a releasing unit 43 is connected to the center of the torsion spring 64. The down side of the latch is made as a round shape for the smooth moving of the stopper in the guiding groove at the stopping bumps.

When the wire moving the polygonal lifting unit is cut due to damage, or the handle is off handed by the false of users, the present invention prevents from the falling of the polygonal lifting unit by automatic stopping at a stopping bump.

Figure 5:
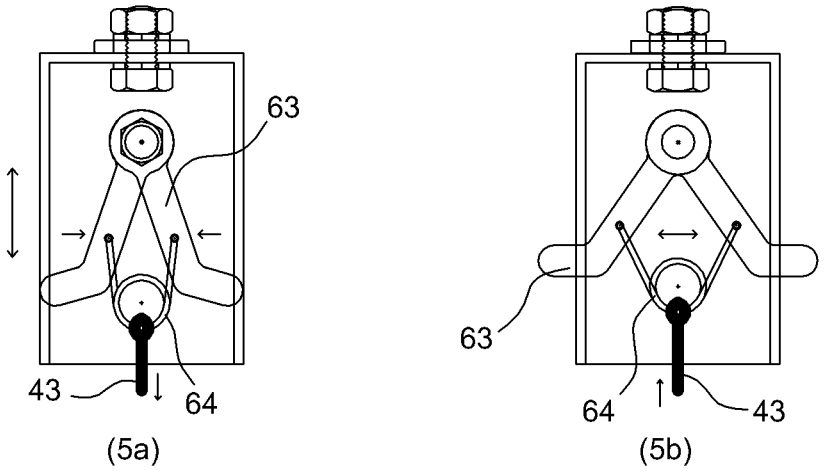
FIG. 5 illustrates the operation state of the stopper according to the present invention.

FIG. 5 illustrates the operation state of a stopper unit according to the present invention. FIG. 5*a* shows the retracting state with ascending and FIG. 5*b* shows the spreading sate with stopping.

When the polygonal lifting unit 60 with ascending is clamped at the stopping bump of the polygonal pipe cylinder, the stopper is to clamp the polygonal lifting unit to the stopping bump by widening the stopper outside by the action of spring tension. When the polygonal lifting unit 60 is descending, a releasing unit 43 is to be pulled for the releasing clamp by retracting the stopper inside by the action of spring tension. And a next step is to lower the polygonal lifting unit by releasing a wire 3.

Since the releasing unit is almost no load, a rope, a wire, a small chain, and etc. can be used.

Since the lighting apparatus 22 which is connected to a protrusion part of the polygonal lifting unit is ascending or descending together with the polygonal lifting unit 60, the easy installation and the convenient maintenance of the lighting apparatus can be done.

The wire which is connected to the fixing bracket 62 installed at the upper side of the polygonal lifting unit 60 moves up and down the polygonal lifting unit by winding or releasing the wire through a lifting control unit 4.

The lifting control unit 4 comprises: a wire control unit 42 adjusting the wire length by winding or releasing the wire; a releasing unit 43 releasing clamp of the stopper which is installed in the down side of the polygonal lifting unit; and a turn roller 40 installed to the top of the polygon pipe cylinder, which is changing the tensile direction by hooking the wire.

The wire 3 which is connected to the wire fixing bracket 62 of the polygonal lifting unit 60 is winded in the wire control unit 42 hooked to the turn roller. The wire control unit is installed in the down side of the polygonal pipe cylinder 50. The polygonal lifting unit 60 is ascended or descended by winding or releasing the wire through the wire control unit 42.

When the polygonal lifting unit is descending, the releasing unit which is connected to the stopper pulls the spring 64 to retract the stopper 63 for the releasing the clamped polygonal lifting unit 60.

The wire control unit 42 is formed in the down side of the inner wall of the polygonal pipe cylinder 50. The wire control unit includes the wire drum winding the wire 3 and the winding handle that rolls the wire drum. The winding handle is connected to a side of the wire drum.

The winding handle rolling the wire drum is detachable, which is removed at the unused time. The winding handle is operated by hand or a motor.

The safe lighting system using wall mounted lift according to the present invention can be applied to a street lighting system and various lighting system.

What is claimed is:

1. A safe lighting system, comprising:

a polygonal pipe cylinder installing at a building wall;

a polygonal lifting unit moving up and down along an inner wall of the polygonal pipe cylinder;

a wire adjusting the height of the polygonal lifting unit, wherein the wire is connected to an upper side of the polygonal lifting unit;

a lifting control unit controlling the height of the polygonal lifting unit by winding or releasing the wire; and a lighting apparatus installed at the polygonal lifting unit, wherein the height of the lighting apparatus is adjusted by the lifting control unit, and the installation and the maintenance of the lighting apparatus can be done on the ground by lowering the lighting apparatus, wherein the polygonal lifting unit has a stopper in a lower side for stopping the polygonal lifting unit to a stopping bump which is formed periodically with a certain distance in the inner wall of the polygonal pipe cylinder.

2. The safe lighting system of claim 1, wherein the polygonal lifting unit and the polygonal pipe cylinder is the same hexagonal shape so that the polygonal lifting unit is inserted into the polygonal pipe cylinder.

3. The safe lighting system of claim 1, wherein one side of the polygonal pipe cylinder is fixed to a wall and an opening is formed in the opposite side of the polygonal pipe cylinder along the longitudinal direction.

4. The safe lighting system of claim 1, wherein stopping bumps are symmetrically formed in the inner wall of the polygonal pipe cylinder.

5. The safe lighting system of claim 1, wherein one side of the polygonal lifting unit is protruded outside through the opening of the polygonal pipe cylinder, and an inserting hole is formed in a protrusion part for fixing the lighting apparatus to the bracket of the lighting apparatus.

6. The safe lighting system of claim 1, wherein the lifting control unit, comprising:

a wire control unit adjusting the wire length by winding or releasing the wire;

a releasing unit releasing the stopper which is formed in the lower side of the polygonal lifting unit; and a turn roller installed to the upper side of the polygon pipe cylinder, which is changing the tensile direction by hooking the wire.

7. The safe lighting system of claim 1, wherein the stopper is an 'L' shaped latch which has mirror symmetry.

8. The safe lighting system of claim 1, wherein a torsion spring is connected to both sides in a lower side of the stopper, and the releasing unit is connected to the center of the torsion spring.

9. The safe lighting system of claim 1, wherein the stopper prevents from dropping the polygonal lifting unit on the ground by self-widening of the stopper when the wire is cut or released.

* * * * *